United States Patent [19]

Selling et al.

[11] 3,979,177

[45] Sept. 7, 1976

[54] METHOD FOR THE MANUFACTURE OF VOLUMINOUS BLENDED YARNS AND FABRICS AND KNITTINGS TO BE MANUFACTURED FROM THEM

[75] Inventors: Hendrak Johannes Selling, Voorburg; Hendrik Van Lingen, The Hague; Njo Hong Han, all of Netherlands

[73] Assignee: Nederlande Organisatie Voor Toegepast-Natuurwetenschappelijk Onderzoek Ten Behoeve Van Nijverheid Handle En Verkeer, The Hague, Netherlands

[22] Filed: Dec. 3, 1973

[21] Appl. No.: 420,935

[52] U.S. Cl. ..... 8/115.7; 8/117; 8/125; 57/140 BY

[51] Int. Cl.[2] ..... D08M 9/04

[58] Field of Search ..... 8/125, 115.7, 117

[56] References Cited

UNITED STATES PATENTS

| | | | |
|---|---|---|---|
| 2,985,416 | 6/1961 | Wood | 8/125 |
| 3,507,609 | 4/1970 | Gorrafa | 8/115.7 |

FOREIGN PATENTS OR APPLICATIONS

| | | | |
|---|---|---|---|
| 758,102 | 9/1956 | United Kingdom | 8/115.7 |

OTHER PUBLICATIONS

Edelstein, S. M. "Mercerizing Cotton-Synthetic Blends," Modern Textiles Magazine, Apr. 1964, pp. 26, 29 & 30.

*Primary Examiner*—Wilbert J. Briggs, Sr.
*Attorney, Agent, or Firm*—Hammond & Littell

[57] ABSTRACT

A method for the manufacture of voluminous blended yarns and fabrics, consisting of flax fibers and non-shrinkable synthetic fibers, which yarns or fabrics are given a swelling treatment, the fibers being subjected to a tensionless shrinkage procedure such that the flax fibers maximally shrink by 35%. For that purpose in the event of fabrics a cloth is started from of such a construction that also in the wet state during shrinkage no tensions in the fabrics occur.

9 Claims, No Drawings

METHOD FOR THE MANUFACTURE OF VOLUMINOUS BLENDED YARNS AND FABRICS AND KNITTINGS TO BE MANUFACTURED FROM THEM

BACKGROUND OF THE INVENTION

The invention relates to a method for the manufacture of voluminous blended yarns and fabrics and knittings to be manufactured from them.

Flax distinguishes itself from cotton by its polygonal section, its high degree of orientation and its straight cylindrical shape. Furthermore, during growth a pectinous substance is produced between the elementary fibres that lutes (i.e., adheres) these elementary fibres as polygonal cylinders with the flat sides against each other.

The yarn, manufactured from flax fibres, therefore, is very compact and the small amount of air, present between the elementary fibres, is the cause of the cool touch of linen fabrics. The said morphology causes these fibres to have very little stretch. This is one of the causes due to which linen fabrics practically cannot be made crease-resistant because this process can only be realized at the cost of a very great loss in resistance to wear. Linen fabrics treated this way actually cannot be used in practice.

It has been tried to reduce highly creasing of linen fabrics by blending the flax fibres with, for instance, polyester fibres, of which it is known that they possess very good crease-resistant qualities. When these polyester fibres are applied up to a percentage of 75–80% in a blend with flax (25–20%), the crease-resistant qualities of the mixture are reasonable. Modern easy-care qualities, however, also comprise the requirement of a good wash and wear rating, i.e. a smoothness after washing causing ironing to be substantially superfluous. By applying blends of flax with synthetic fibres these desirable effects cannot be attained, however. In order to obtain an acceptable wash and wear rating the blended fabric must be subjected to a treatment with a synthetic resin having cross-linking properties. This treatment with synthetic resin is only effective on the flax fibres present. In view of this it is necessary that a minimum of 40% of flax fibres is present in the blend so as to enable the observation of a significant result of the synthetic resin treatment. Unfortunately in blends of this composition the flax fibres treated wear rather badly.

Summarizing it may be posed that because of the natural morphology the use of the flax fibres remains restricted to cool smooth fabrics, which even under addition of polyester fibres cannot be made satisfactorily easy-care. This is also stressed by the fact that neither in the technical literature nor in the patent literature can much be found regarding blended yarns in which flax fibres have been processed.

It is the object of the invention not only to extend the application of flax fibres to voluminous blended yarns and the fabrics and knittings manufactured from them, but also to improve the easy-care qualities of these products.

THE INVENTION

The method for manufacturing voluminous blended yarns is, according to the invention, characterized in that a blended yarn, consisting of flax fibres and non-shrinkable synthetic fibres, is given a swelling treatment, the yarn being subjected to a tensionless shrinkage procedure such that the flax fibres shrink maximally 35%.

The result is that the synthetic fibres are subjected to buckling.

As synthetic fibres preferably polyester fibres are used.

As a result of the high degree of orientation and the high modulus of elasticity of the flax fibres, a very high degree of shrinkage arises in the event of a swelling treatment, e.g. in technical lye, while in doing so, the shrinkage force is very high. During the shrinkage procedure the polyester fibre does not shrink and the flax fibre shrinks by approx. 35%. As a result of the high shrinkage force of the flax, polyester is butted (subjected to buckling), hence two phenomena are clearly perceivable, viz.:

a. the flax elementary fibres are pushed apart;

b. the polyester fibres are forced outward.

Surprisingly it was found that a flax polyester yarn thus treated was so voluminous that the percentage of air between the fibres can exceed even that of wool.

Fabrics and knittings, manufactured from this yarn, consequently have a heat-insulating capacity that at least is equal to that of a comparable woolen fabric.

Any treatment which gives rise to swelling and shrinking of the fibres can be applied, such as for instance a treatment with humid hot air. However, preferably the fibreblend or the loosely manufactured fabric or cloth is treated with a technical grade of caustic soda solution having a concentration between about 15 and 24 percent by weight of NaOH, at about 20°C, by dipping the material to be treated in the lye for about 2 to 5 minutes. Then the caustic soda is rinsed out and the treated material is neutralized in diluted acid. Thereafter the "easy care" treatment may be applied by treating the material with a synthetic resin having cross-linking properties and curing the resin by heating.

Furthermore, this shrinkage treatment is of particular significance for a synthetic resin treatment of the fabric, if it is desired to implement it. The flax fibre, which as a result of the shrinkage treatment is considerably improved regarding its stretch qualities, after the synthetic resin treatment is much better resistant against the loads occurring during wear, but, furthermore, by bringing the polyester fibre to the outside the latter is relatively the most subjected to wear. Thus the flax fibre is getting an additional protection.

In practice the principle is known of so-called "tensionless mercerizing of fabrics". During the treatment no external tension is exerted on the fabric. However this treatment has never been applied to flax containing yarns or fabrics therefrom.

It is known in the art that this (pre)treatment yields very little or no improvement of the crease-resistance by a synthetic resin treatment and the wear resistance. This is not surprising, because during this so-called "tensionless mercerizing" in the fibres, relatively great tensions arise due to the swelling of the fibres during shrinkage, hence, with regard to the fibre, this treatment is not at all a tensionless shrinkage process. If it is desired to prevent this fibre tension during a swelling treatment of the process, in manufacturing the cloth that is subjected to the present treatment, special measures should be taken. These measures should be such that it is loosely woven, so that also in the wet state, in which the yarns and fibres are thicker than in the dry state, the condition is fulfilled that during shrinkage no tensions arise in the fibres. If this last condition is fulfilled, it is also possible to realize the aforementioned effects, i.e.: the fact that the flax elementary fibres are being pushed apart and the polyester being forced outward.

Then the envisaged qualities, viz. improvement of the insulating capacity and a better adaptation to synthetic resin treatment are also attained.

EXAMPLE

Several samples of loosely woven cloths, from both 100% flax and a 50/50 flax/polyester blended yarn were tested according to the AAICC tentative test 93-1966T. Eight cloths were previously subjected to the shrink treatment according to the invention by submerging them in a 20 percent by weight technical caustic soda solution for about 3 minutes, whereupon these were rinsed, neutralized and dried.

Four of the cloths thus treated as well as four non-treated cloths were subjected to an "easy care" treatment with a synthetic resin pre-condensate known in trade as Fixapret AH and cured.

Test results are shown in the table below.

| | Accelarator wear resistance (1500 r.p.m.) in perc./min. | | | |
|---|---|---|---|---|
| | non shrunken | | shrunken | |
| | 100 % flax | 50/50 flax/pol | 100 % flax | 50/50 flax/pol |
| without synthetic resin | 0,85 | 0,6 | 0,9 | 0,65 |
| treated with 150 g/l "Fixapret AH" | 11,7 | 3,4 | 3,7 | 0,9 |

What we claim is:

1. A method for the manufacture of a voluminous blended yarn characterized in that a blended yarn consisting essentially of flax fibres and non-shrinkable synthetic fibres is given a swelling treatment, whereby the yarn is subjected to a tensionless shrinking procedure such that the flax fibres shrink maximally by 35%.

2. A method according to claim 1, wherein the synthetic fibres are polyester fibres.

3. A method as claimed in claim 1 characterized in that a blended yarn consisting essentially of a blend of flax fibres and non-shrinkable synthetic fibres is treated during 2 to 5 minutes in a caustic soda solution containing between 15 and 24 percent by weight of NaOH, rinsed, neutralized and dried.

4. A blended yarn consisting essentially of flax and non-shrinkable fibres made voluminous according to the method of claim 1.

5. A blended yarns composed of flax and polyester fibres made voluminous by the method according to claim 1.

6. A method for the manufacture of fabrics and knittings, wherein these are manufactured from blended yarns treated according to claim 1.

7. A method to improve fabrics and knittings manufactured according to claim 6, characterized in that these fabrics and knittings are subjected to a synthetic resin treatment known per se in order to improve the crease resistance.

8. Fabrics, knittings and the like obtained as a result of the method according to claim 7.

9. A method for the manufacture of voluminous fabrics, knittings and the like consisting essentially of a blend of flax and non-shrinkable fibres characterized in that fabrics, knittings and the like, manufactured from blended yarns consisting essentially of a blend of flax fibres and non-shrinkable synthetic fibres are given a swelling treatment, the fibres thereby being subjected to a tensionless shrinkage procedure such that the flax fibres maximally shrink by 35% and that the fabrics to be treated being woven so loosely that in the wet state during shrinkage no tension occurs in the fibres.

* * * * *

UNITED STATES PATENT OFFICE

CERTIFICATE OF CORRECTION

Patent No. 3,979,177 Dated September 7, 1976

Inventor(s) Hendrak Johannes Selling et al.

It is certified that error appears in the above-identified patent and that said Letters Patent are hereby corrected as shown below:

On the Title Page, Item [30] should read;

December 15, 1972 Netherlands 72 17085

Signed and Sealed this

Fifteenth Day of February 1977

[SEAL]

*Attest:*

RUTH C. MASON
*Attesting Officer*

C. MARSHALL DANN
*Commissioner of Patents and Trademarks*